US005556742A

United States Patent [19]

Barlow et al.

[11] Patent Number: 5,556,742

[45] Date of Patent: Sep. 17, 1996

[54] NOBLE METAL COMPLEXES TO SENSITIZE SILVER HALIDE EMULSIONS

[75] Inventors: Charles G. Barlow, St. Paul, Minn.; Peter R. Johns, Rochester, N.Y.; Peter D. Sills, St. Paul, Minn.

[73] Assignee: Minnesota Mining and Manufacturing Company, St. Paul, Minn.

[21] Appl. No.: 521,544

[22] Filed: Aug. 30, 1995

[51] Int. Cl.[6] ..... G03C 1/09

[52] U.S. Cl. ..... 430/601; 430/605

[58] Field of Search ..... 430/601, 605

[56] References Cited

U.S. PATENT DOCUMENTS 4,001,025 1/1977 Cash ..... 430/600

4,092,171 5/1978 Bigelow ..... 430/605

5,112,733 5/1992 Ihama ..... 430/605

OTHER PUBLICATIONS

"Hydridochlorobis (triphenylphosphine) platinium (II) and Some Related Compounds," Inorganic Chemistry, Jul., 1965, John C. Bailar, Jr., et al., p. 1618.

"Hydrido–complexes of Platinum (II)," Proc. Chem. Soc., 1957, J. Chatt, et al., p. 5075.

*Primary Examiner*—Lee C. Wright

*Attorney, Agent, or Firm*—Gary L. Griswold; Walter N. Kirn; Mark A. Litman

[57] ABSTRACT

Silver halide photographic emulsions may be sensitized by the use of hydrido-phosphine noble metal compounds and especially platinum (II) compounds.

19 Claims, No Drawings

NOBLE METAL COMPLEXES TO SENSITIZE SILVER HALIDE EMULSIONS

FIELD OF THE INVENTION

This invention relates to photographic elements containing silver halide crystals as the light sensitive particles and to methods of increasing their sensitivity to actinic radiation.

BACKGROUND OF THE INVENTION

Methods for increasing the sensitivity of silver halide crystals to light are well known and discussed in detail in "The Theory of the Photographic Process," 4th edition, edited by T. H. James, pp. 149–169. The most common methods of chemical sensitization are classified as sulfur sensitization, gold sensitization and reduction sensitization. The first two classes are commonly combined to get the highest increase in sensitivity. Less commonly, reduction sensitization is combined with one of the other methods. James points out that it is difficult to successfully combine gold and reduction sensitization. There are many published claims for other methods of sensitization, especially using various noble metals such as Platinum, Palladium or Iridium. However, in most emulsions based on gelatin as the colloid, the simple salts or complexes of these metals do not increase the sensitivity because the gelatin forms strong complexes with the metal which prevents deposition of the metal onto the crystal surface. If the colloid has no reactive sites for the noble metal to form complexes, such as polyvinyl alcohol, then the metals do act as sensitizers.

It is also known that chemical sensitization can influence the reciprocity failure characteristics of the emulsion. Sulfur sensitization increases high intensity failure, while sulfur plus gold reduces this failure. Reduction sensitization or a reducing treatment before exposure tend to eliminate low intensity failure.

In the formulation of photographic products, it is often necessary to control the reciprocity failure while also increasing the overall sensitivity by using combinations of sensitizers and novel sensitizers.

SUMMARY OF THE INVENTION

One aspect of this invention is to provide a new process for increasing the light sensitivity of silver halide photographic emulsions by using novel complexes of noble metals. An additional aspect is to control the reciprocity failure characteristics of emulsions by combining these novel compounds with other sensitizers such as sulfur and/or gold. The new compounds combine in one molecule a noble metal such as Platinum which can act as a sensitizer and a reducing function. Where the noble metal is strongly complexed by ligands such as phosphine, it is not available for complexation by gelatin.

The invention is practiced with the use of a new class of sensitizers for silver halide which have the general formula:

$$(R_3P)xMXyHz$$

where M is a noble metal such as Platinum, Palladium, or Iridium, x is 2 or 3 (depending upon the volume of M), y is 1 or 2, X is a halide such as chloride, bromide or iodide or a pseudohalide ligand such as cyano, nitroso, etc. and z is 1 or 2 R represents any organic radical which can be alkyl, aryl, heterocyclic or alicyclic. Such compounds may be synthesized by the reduction of the corresponding halo phosphine complexes as reported by Chatt and Shaw in the Journal of the Chemical Society (1962), page 5075 and by Bailar and Itatani in Inorganic Chemistry (1965), page 1618.

BRIEF DESCRIPTION OF THE INVENTION

In our research to find ways to increase the photographic sensitivity of silver halide emulsions, we have discovered a class of compounds which incorporate both the noble metals such as Platinum complexed by phosphines and a reducing function into one molecule so that the metal cannot be complexed by the gelatin colloid. As a result these compounds efficiently sensitize silver halide emulsions particularly when combined with sulfur sensitizers or with sulfur and gold sensitizers. Particular combinations have been shown to be desirable for different exposure times.

Typical examples of useful compounds which can be used in the present invention are:

$((CH_3)_3P)_2PtClH$ $((C_2H_5)_3P)_2PtClH$ $((C_6H_5)_3P)_2PtClH$ $((CH_3)_3P)_2PtBrH$ $((C_2H_5)_3P)_2PtBrH$ $((C_6H_5)_3P)_2PtBrH$ $((CH_3)_3P)_2PdClH$ $((C_2H_5)_3P)_2PdClH$ $((C_6H_5)_3P)_2PdClH$ $((CH_3)_3P)_2PdBrH$ $((C_2H_5)_3P)_2PdBrH$ $((C_6H_5)_3P)_2PdBrH$ $((CH_3)_3P)_3IrCl_2H$ $((C_2H_5)_3P)_3IrCl_2H$ $((C_6H_5)_3P)_3IrCl_2H$ $((CH_3)_3P)_3IrBr_2H$ $((C_2H_5)_3P)_3IrBr_2H$ $((C_6H_5)_3P)_3IrBr_2H$ $((CH_3)_3P)_3IrClH_2$ $(C_2H_5)_3P)_3IrClH_2$ $((C_6H_5)_3P)_3IrClH_2$

In the practice of the present invention, the novel compounds are added in an amount ranging from about 2 to 200 micromoles per mole of silver halide. It is preferred that the compounds are added in a range of from 5 to 100 micromoles per mole of silver halide. They may be added to the emulsion as dilute solutions in an organic, water miscible solvent such as methanol or acetone.

DETAILED DESCRIPTION OF THE INVENTION

Any of the various types of photographic silver halide emulsions may be used in the practice of the present invention. Silver chloride, silver bromide, silver bromoiodide, silver chlorobromide, silver bromochloride, silver bromochloroiodide, silver chlorobromoiodide and mixtures thereof may be used for example.

Any configuration of grains, cubic, orthorhombic, hexagonal, tabular, epitaxial or mixtures thereof may be used. These emulsions are prepared by any of the well known procedures, e.g., single or double jet emulsions as described by Wietz et al., U.S. Pat. No. 2,222,264, Illingsworth, U.S. Pat. No. 3,320,069, McBride, U.S. Pat. No. 3,271,157 and U.S. Pat. Nos. 4,425,425 and 4,425,426.

The silver halide emulsions of this invention may be unwashed or washed to remove soluble salts by products. In the latter case the soluble salts can be removed by chill setting and leaching or the emulsion can be coagulation washed e.g., by the procedure described by Hewitson et al., U.S. Pat. No. 2,618,556; Yutzy et al., U.S. Patent 2,614,928; Yackel, U.S. Pat. No. 2,565,418; Hart et al., U.S. Pat. No. 3,241,969; and Waller et al., U.S. Pat. No. 2,489,341.

Silver halide emulsions of this invention can be protected against the production of fog and stabilized against changes in sensitivity during keeping by the addition of antifoggants and stabilizers alone or in combination, these can include the thiazolium salts described in Staud, U.S. Pat. No. 2,131,038 and Allen U.S. Pat. No. 2,694,716; the azaindines described in Piper, U.S. Pat. No. 2,886,437 and Heimbach U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent 623,448; nitron; nitroindazoles; the polyvalent metal salts described in Jones, U.S. Pat. No. 2,839,405; and the thiuronium salts described in Herz, U.S. Pat. No. 3,220,839.

Silver halide emulsions in accordance with this invention can be dispersed in various hydrophilic colloids alone or in combination as vehicles or binding agents. Suitable hydrophilic materials include both naturally occurring substances such as proteins, for example gelatins derived animal bones and hides by the acid or liming process and chemically modified gelatins, e.g., (phthalated, succinylated, etc.) cellulose derivatives, polysaccharides, such as dextran, gum arabic and the like; and synthetic substances such as water soluble polyvinyl compounds, e.g., poly(vinyl pyrrolidone), acrylamide polymers or other synthetic polymeric compounds such as dispersed vinyl compound in latex form, and particularly those that increase the dimensional stability of photographic materials. Suitable synthetic polymers include those described, for example, in U.S. Pat. Nos. 3,142,568 of Nottorf; U.S. Pat. No. 3,193,386 of White; U.S. Pat. No. 3,062,674 of Houck, Smith and Yudelson; U.S. Pat. No. 3,220,844 of Houck, Smith and Yudelson; Ream and Fowler, U.S. Pat. No. 3,287,289; and Dykstra, U.S. Pat. No. 3,411,911; particularly effective are those water insoluble polymers of alkyl acrylates and methacrylates, acrylic acid, sulfoalkyl acrylates or methacrylates, those which have cross linking site which facilitate hardening or curing and those having recurring sulfobetaine units as described in Canadian Patent 774,054.

Photographic silver halide emulsions of this invention can be dispersed in colloids that may be hardened by various organic and inorganic hardeners, alone or in combination, such as the aldehydes, ketones, carboxylic and carbonic acid derivatives, sulfonate esters, sulfonyl halides, and vinyl sulfones, active halogen compounds, epoxy compounds, aziridines, active olefins, isocyanates, carbodiimides, mixed function hardeners such as oxidized polysaccharides, e.g., dialdehyde starch, oxyguargum, etc.

Emulsions in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,3 12 or insoluble inorganic salts such as those described in Trevoy, U.S. Pat. No. 3,428,451.

The photographic emulsions of this invention can be coated on a wide variety of supports. Typical supports include polyester film, subbed polyester film, poly(ethylene terephthalate) or poly(ethylene naphthalene) film, cellulose ester film, poly(vinyl acetal) film, poly carbonate film, and related resinous materials, as well as glass, metal paper and the like. Typically, a flexible support is employed, especially a paper support, which can be partially acetylated or coated with baryta and/or an alpha-olifin polymer, particularly a polymer of an alpha-olefin containing 2 to 10 carbon atoms such as polyethylene, polypropylene, ethylenebutene copolymers and the like.

Emulsions of this invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent 955,061.

The photographic emulsions as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers as described herein can contain matting agents such as starch, titanium dioxide, silica, zinc oxide, polymeric beads including beads of the type described in Jelley et al., U.S. Pat. No. 2,992,101 and Lynn, U.S. Pat. No. 2,701,245.

Emulsions of the invention can be utilized in photographic elements which contain brightening agents including stilbene, triazine, oxazole and coumarin brightening agents. Water soluble brightening agents can be used such as those described in Albers et al., German Patent 927,067 and McFall et al., U.S. Pat. No. 2,933,390 or dispersions of brighteners can be used such as those described in Jansen, German Patent 1,150,274 and Oetiker et al., U.S. Pat. No. 3,406,070.

Photographic elements containing emulsion layers according to the present invention can be used in photographic elements which contain light absorbing materials and filter dyes such as those described in Sawdey, U.S. Pat. No. 3,253,921; Gaspar, U.S. Pat. No. 2,274,782; Carrol et al., U.S. Pat. No. 2,257,583 and Van Campen U.S. Pat. No. 2,956,879. If desired the dyes may be mordanted, for example as described in Milton and Jones, U.S. Pat. No. 3,282,699.

Contrast enhancing additives such as hydrazines, rhodium, iridium, and combinations thereof are also useful.

Photographic emulsions of this invention can be coated by various coating procedures including dip coating, slot coating, air knife coating curtain coating, or extrusion coating using hoppers of the type described in Beguin, U.S. Pat. No. 2,681,294. If desired two or more layers may be coated simultaneously by the procedures described in Russell, U.S. Pat. No. 2,761,791 and Wynn British Patent 837,095.

The silver halide photographic elements can be used to form dye images therein through the selective formation of dyes. The photographic elements described above for forming silver images can be used to form dye images by employing developers containing dye image formers, such as color couplers, as illustrated by U.K. Patent 478,984; Yager et al., U.S. Pat. No. 3,113,864; Vittum et al., U.S. Pat. Nos. 3,002,836, 2,271,238 and 2,362,598, Schwan et al., U.S. Pat. No. 2,950,970; Carroll et al., U.S. Pat. No. 2,592,243; Porter et al., U.S. Pat. Nos. 2,343,703, 2,376,380 and 2,369,489; Spath U.K. Patent 886,723 and U.S. Pat. No. 2,899,306; Tuite U.S. Pat. No. 3,152,896 and Mannes et al., U.S. Pat. Nos. 2,115,394, 2,252,718 and 2,108,602, and Pilato U.S. Pat. No. 3,547,650. In this form the developer contains a color developing agent, e.g., a primary aromatic amine which in its oxidized form is capable of reacting with the coupler (coupling) to form the image dye. Also, instant self developing diffusion transfer film can be used.

The dye-forming couplers can be incorporated in the photographic elements, as illustrated by Schneider et al., *Die Chemie*, Vol. 57, 1944 p. 113, Mannes et al., U.S. Pat. No. 2,304,940, Martinez U.S. Pat. No. 2,269,158, Jelley et al., U.S. Pat. No. 2,376,697, Fierke et al., U.S. Pat. No. 2,801,171, Smith U.S. Pat. No. 3,748,141, Tong U.S. Pat. No. 2,772,163, Thirtle et at., U.S. Pat. No. 2,835,579, Sawdey et al., U.S. Pat. No. 2,533,514, Peterson U.S. Pat. No. 2,353,745, Seidel U.S. Pat. No. 3,409,435, and Chen Research Disclosure, Vol. 159, July 1977, Item 15930. the dye forming couplers can be incorporated in different amounts to achieve differing photographic effects. For example, U.K. Patent 923,045 and Kumai et al., U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are non-diffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high boiling organic (coupler) solvents.

The couplers may be present either directly bound by a hydrophilic colloid or carried in a high boiling organic solvent which is then dispersed within a hydrophilic colloid. The colloid may be partially hardened or fully hardened by any of the variously known photographic hardeners. Such hardeners are free aldehydes, U.S. Pat. No. 3,232,764, aldehyde releasing compounds, U.S. Pat. Nos. 2,870,013 and 3,819,608, s-triazines and diazines U.S. Pat. Nos. 3,325,287 and 3,992,366, aziridines, U.S. Pat. No. 3,217,175, vinylsulfones, U.S. Pat. No. 3,490,911, carboimides and the like may be used.

Other conventional photographic addenda such as coating aids, spectral sensitizers, antistatic agents, accutance dyes, antihalation dyes, antifoggants, stabilizers, latent image stabilizers, antikinking agents, lubricating agents, matting agents and the like may also be present.

EXAMPLES

The use of the present new sensitizing compound is demonstrated by the following examples.

Example 1

A monodisperse/silver halide photographic emulsion comprising silver bromide 99% and 1% iodide with an average grain size about 0.25μ was divided into three portions and sensitized by heating at 55 degrees C. with the following compounds:

(a) 0.1 mMole of sodium thiosulfate per mole of silver halide, (b) 0.1 mMole of sodium thiosulfate and 0.040 mMole of sodium tetrachloroaurate, (c) 0.1 mMole of sodium thiosulfate and 0.010 mMole of transhydridochlorobistriethylphosphineplatinum(II), Heating was continued until each portion reached the optimum speed and fog when they were cooled and then stabilized by tetra-azaindene. Before coating onto polyester base, normal surfactants and gelatin hardeners were added. The resultant coatings were exposed to a step wedge for 1 second and processed in microfilm developer and fixer. The sensitometry of the coatings was:

| | Fog | Relative Log speed | Contrast |
|---|---|---|---|
| (a) | 0.02 | 2.00 | 1.91 |
| (b) | 0.08 | 2.66 | 2.26 |
| (c) | 0.09 | 2.60 | 2.45 |

The influence of exposure time on the sensitizing ability of the platinum compound was examined by exposing the samples (b) and (c) at a range of times from 0.1 to 100 seconds with appropriate change in the light intensity by neutral density filters. The difference in speed (∂S) expressed as log speed of (b) minus log speed of (c) shows how the platinum compound became more efficient than gold as a sensitizer when longer exposure times were used.

| | | | | | |
|---|---|---|---|---|---|
| Exposure time | 0.1 | 1.0 | 10 | 100 | seconds |
| ∂S | 0.176 | 0.050 | 0.020 | −0.013 | |

Example 2

An emulsion having grains with average size of 1.2μ containing 98% bromide and 2% iodide was split into four portions which were sensitized by heating at 55 degrees C with the following additives:

(a) 25 μMoles of sodium thiosulfate per mole of silver halide, (b) 25 μMoles of sodium thiosulfate and 4 μmoles of sodium tetrachloraurate, (c) 25 μMoles of sodium thiosulfate and 12 μmoles of transhydridochlorobistriethylphosphineplatinum(II), (d) 25 μMoles of sodium thiosulfate and 24 μmoles of transhydridochlorobistriethylphosphineplatinum(II).

The rate of digestion was monitored in the liquid emulsion and when optimum sensitometry was reached the samples were cooled and stabilized with tetra-azaindene. Before coating, surfactants and gelatin hardeners were added. The emulsions were coated on both sides of 7 mil blue polyester base and exposed in a double sided sensitometer. After processing in X-ray developer the resultant sensitometry was:

| | Fog | Log speed | contrast |
|---|---|---|---|
| (a) | 0.34 | 2.00 | 0.83 |
| (b) | 0.21 | 2.34 | 1.07 |
| (c) | 0.27 | 2.34 | 0.77 |
| (d) | 0.23 | 2.46 | 0.80 |

Example 3

This example demonstrates the use of the platinum compound in a spectrally sensitized emulsion, specifically an infra-red sensitized emulsion. It also demonstrates the effect of the compound when combined with sulfur and gold compounds and the resultant sensitometry at different exposure times.

A monodisperse emulsion of silver bromide with a mean grain size of 0.24 μ was digested at 50 degree C, pH 5.2 with the following sensitizers:

(a) 10 μmoles of N-methylthiosuccinimide (NMTS)

(b) 10 μmoles of N-methylthiosuccinimide (NMTS) and 10 μmoles of sodium tetrachloroaurate with 10 μmoles of p-toluene thiosulfinic acid (PTS)

(c) 10 μmoles of N-methylthiosuccinimide (NMTS) and 10 μmoles of transhydridochlorobistfiethylphosphineplatinum(II), (d) 10 μmoles of N-methylthiosuccinimide (NMTS) and 20 μmoles of transhydridochlorobistriethylphosphineplatinum(II), (e) 10 μmoles of N-methylthiosuccinimide (NMTS) and 30 μmoles of transhydridochlorobistriethylphosphineplatinum(II), (f) 10 μmoles of N-methylthiosuccinimide (NMTS) and 10 μmoles of transhydridochlorobistriethylphosphineplatinum(II), plus 10μmoles of sodium tetrachloroaurate plus 10 μmoles of p-toluene thiosulfinic acid (PTS).

After digestion to optimum sensitometry as followed by tests on the liquid emulsion they were stabilized with tetra-azaindene and cooled. Before coating the emulsions were sensitized to infra-red radiation by dye an infrared spectral sensitizing dye (a benzoxazole heptacyanine), supersensitized by the styryltriazine brightener Leucophor BCF, and hardener and surfactant were added. The emulsions were coated onto 7 mil blue polyester base which had an anti-halation dye coating on the reverse side.

After exposures as detailed below the coatings were developed in Kodak RP-Xomat chemistry for 90 seconds dry to dry.

| | fog | Log speed | contrast | Dmax |
|---|---|---|---|---|
| (A) Exposure to a laser diode emitting at 820 nm with a spot exposure time of 1μ second. | | | | |
| (a) | 0.17 | 1.92 | — | 1.80 |
| (b) | 0.17 | 2.62 | 2.38 | 3.02 |
| (c) | 0.17 | 1.69 | — | 1.22 |
| (d) | 0.17 | 1.82 | — | 1.50 |
| (e) | 0.17 | 1.89 | — | 1.67 |
| (f) | 0.17 | 2.77 | 2.37 | 3.11 |
| (B) Exposure to a narrow pass filter at 820 nm with exposure time of 20 seconds | | | | |
| (a) | 0.17 | 2.04 | — | 1.87 |
| (b) | 0.18 | 2.03 | 1.61 | 2.82 |
| (c) | 0.17 | 2.49 | 2.00 | 2.92 |
| (d) | 0.17 | 2.51 | 1.98 | 3.04 |
| (e) | 0.17 | 2.57 | 2.07 | 3.10 |
| (f) | 0.17 | 2.18 | 1.68 | 3.00 |

Note where contrast is shown as - - - Dmax was too low to measure contrast as defined by the sensitometry program used.

Example 4

A pure silver bromide laminar emulsion was sensitized (per mole of silver halide) 0.1% (benzothiazolium ethiodide) 25 ml, (paratoluene sulfonate) 20% 30 ml, 0.1% (paratoluene thiosulfinate) 25 ml, and 1.4 μmole of gold thiocyanate plus the amounts of transhydridochlorobistriethylphosphineplatinum(II) shown and sensitometry measured. Digestion was at 55 degree F. After digestion the emulsions were stabilized by tetra-azaindene and spectrally sensitized by a green sensitizing cyanine dye. The emulsions were coated onto blue 7 mil polyester base and after exposure were developed in Kodak RP-Xomat chemistry.

| μ mole Pt compound | fog | Log speed | Dmax |
|---|---|---|---|
| 0.0 | 0.25 | 1.53 | 2.06 |
| 20 | 0.32 | 1.42 | 1.99 |
| 40 | 0.35 | 1.42 | 2.01 |
| 80 | 0.34 | 1.58 | 2.06 |
| 160 | 0.29 | 1.58 | 1.97 |

What is claimed:

1. A method for sensitizing photographic silver halide emulsions which comprises sensitizing a photographic silver halide emulsion in the presence of a hydrido-phosphine platinum(II) compound.

2. A method for sensitizing a photographic silver halide emulsion comprising sensitizing a photographic silver halide emulsion in the presence of a compound of the formula:

$$(R_3P)xMXyHz$$

where M is a noble metal, x is 2 or 3, y is 1 or 2, X is a halide or a pseudohalide ligand, and z is 1 or 2 and R represents an organic radical.

3. The method of claim 2 wherein M is Platinum, Palladium, or Iridium.

4. The method of claim 2 wherein said halide is chloride, bromide or iodide.

5. The method of claim 2 wherein said pseudohalide comprises cyano or nitroso.

6. The method of claim 3 wherein R is an alkyl, aryl, heterocyclic or alicyclic group.

7. The method of claim 4 wherein R is an alkyl, aryl, heterocyclic or alicyclic group.

8. The method of claim 5 wherein R is an alkyl, aryl, heterocyclic or alicyclic group.

9. The method of claim 4 wherein M is Platinum, Palladium, or Iridium.

10. The method of claim 5 wherein M is Platinum, Palladium, or Iridium.

11. The method of claim 2 wherein said compound is selected from the group consisting of $((CH_3)_3P)_2PtClH$ $((C_2H_5)_3P)_2PtClH$ $((C_6H_5)_3P)_2PtClH$ $((CH_3)_3P)_2PtBrH$ $((C_2H_5)_3P)_2PtBrH$ $((C_6H_5)_3P)_2PtBrH$ $((CH_3)_3P)_2PdClH$ $((C_2H_5)_3P)_2PdClH$ $((C_6H_5)_3P)_2PdClH$ $((CH_3)_3P)_2PdBrH$ $((C_2H_5)_3P)_2PdBrH$ $((C_6H_5)_3P)_2PdBrH$ and $((CH_3)_3P)_3IrCl_2H$ $((C_2H_5)_3P)_3IrCl_2H$ $((C_6H_5)_3P)_3IrCl_2H$ $((CH_3)_3P)_3IrBr_2H$ $((C_2H_5)_3P)_3IrBr_2H$ $((C_6H_5)_3P)_3IrBr_2H$ $((CH_3)_3P)_3IrClH_2$ $(C_2H_5)_3P)_3IrClH_2$ $((C_6H_5)_3P)_3IrClH_2$.

12. The method of claim 2 wherein M is Platinum.

13. The method of claim 3 wherein M is Platinum.

14. The method of claim 4 wherein M is Platinum.

15. The method of claim 2 wherein said sensitization is performed in the presence of thiosulfate also.

16. The method of claim 14 wherein said sensitization is performed in the presence of thiosulfate also.

17. The method of claim 6 wherein said sensitization is performed also in the presence of thiosulfate.

18. The method of claim 10 wherein said sensitization is performed also in the presence of thiosulfate.

19. The method of claim 10 wherein said sensitization is performed in the presence of N-methylthiosuccinimide.

* * * * *